US008093817B2

(12) United States Patent
Frumau et al.

(10) Patent No.: US 8,093,817 B2
(45) **Date of Patent: *Jan. 10, 2012**

(54) METHOD AND SYSTEM FOR LIGHTING CONTROL

(75) Inventors: Constantinus Carolus Franciscus Frumau, Eindhoven (NL); Stefan Marcus Verbrugh, Eindhoven (NL); Sander Nijdam, Eindhoven (NL); Bennie Simpelaar, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1034 days.

This patent is subject to a terminal disclaimer.

(21) Appl. No.: 11/912,168

(22) PCT Filed: Apr. 20, 2006

(86) PCT No.: PCT/IB2006/051223

§ 371 (c)(1), (2), (4) Date: Oct. 22, 2007

(87) PCT Pub. No.: WO2006/111934

PCT Pub. Date: Oct. 26, 2006

(65) Prior Publication Data

US 2008/0203928 A1 Aug. 28, 2008

(30) Foreign Application Priority Data

Apr. 22, 2005 (EP) ..... 05103279

(51) Int. Cl.
*H05B 37/02* (2006.01)
*G08B 13/14* (2006.01)

(52) U.S. Cl. ..... 315/151; 340/10.1; 340/572.1; 250/227.21

(58) Field of Classification Search .... 340/572.1–572.8, 340/825.21, 825.52, 10.1, 10.4, 10.42, 10.52; 315/149–157, 291, 307; 250/214 R, 227.21, 250/227.22
See application file for complete search history.

(56) References Cited

U.S. PATENT DOCUMENTS 5,382,947 A * 1/1995 Thaler et al. ..... 340/12.53
(Continued)

FOREIGN PATENT DOCUMENTS

JP 63005632 A1 1/1988
(Continued)

OTHER PUBLICATIONS

Steven W. Smith: The Scientist and Engineer's Guide to Digital Signal Processing, 1999, California Tech Publishing, pp. 136-140, XP002393499.

*Primary Examiner* — Jacob Y Choi
*Assistant Examiner* — Jimmy Vu

(57) ABSTRACT

A method and a system for controlling at least one lighting arrangement (2), in which the lighting arrangement modulates the light (6, 16, 18) it emits by lighting arrangement data, which contains an identification code identifying the lighting arrangement, a user control device (12) is suitable to receive the light from the lighting arrangement and to derive therefrom the lighting arrangement data, the user control device measures a property of the received light, apart from it representing data, to provide additional data which is associated with the lighting arrangement which is associated with the identification code contained in the received data, the user control device transmits the lighting arrangement data and the additional data, and a main control device (10) is suitable to receive the data transmitted by the user control device and to therewith control the operation of the lighting arrangement.

22 Claims, 3 Drawing Sheets

U.S. PATENT DOCUMENTS

| | | | | |
|---|---|---|---|---|
| 5,838,116 | A | 11/1998 | Katyl et al. | |
| 6,198,230 | B1 | 3/2001 | Leeb et al. | |
| 6,333,605 | B1 | 12/2001 | Grouev et al. | |
| 6,567,032 | B1 * | 5/2003 | Mullaly et al. | 341/176 |
| 7,024,119 | B1 * | 4/2006 | Mier-Langner et al. | 398/106 |
| 7,710,271 | B2 * | 5/2010 | Frumau | 340/572.1 |
| 2002/0043938 | A1 | 4/2002 | Lys | |
| 2003/0210167 | A1 * | 11/2003 | Weng | 341/176 |
| 2004/0160199 | A1 * | 8/2004 | Morgan et al. | 315/312 |
| 2005/0231134 | A1 | 10/2005 | Sid | |

FOREIGN PATENT DOCUMENTS

| | | | |
|---|---|---|---|
| JP | 0266875 | A1 | 3/1990 |
| WO | 0213490 | A2 | 2/2002 |
| WO | 2004023224 | A2 | 3/2004 |
| WO | 2004023702 | A2 | 3/2004 |
| WO | 2004038962 | A1 | 5/2004 |
| WO | 2004057927 | A1 | 7/2004 |
| WO | 2005062680 | A1 | 7/2005 |
| WO | 2005096677 | A1 | 10/2005 |

* cited by examiner

METHOD AND SYSTEM FOR LIGHTING CONTROL

FIELD OF THE INVENTION

The present invention relates in general to a method and device for controlling a lighting system comprising a plurality of light sources. The invention relates particularly to a method for controlling a lighting system and such a system as described in the preambles of claim 1 and 5 respectively.

BACKGROUND OF THE INVENTION

WO 2004/057927 discloses a method for configuration a wireless controlled lighting system. The prior art system comprises a central master control device, several local control master devices, which are linked to the central master device, and, associated with each local control master device, one or more lighting units and a portable remote control. Each lighting unit and the portable control are linked to their associated local control master device by a wireless connection. Light emitted by a lighting unit is modulated by an identification code, which was stored in the lighting unit before controlling the lighting unit. The portable control is suitable to receive the modulated light and to derive therefrom the identification code of the source lighting device. The portable control has an user interface by which an user can enter additional data, which is sent to its associated local control master device together with the identification code received from a lighting unit. Said additional data may contain an indication of a switch or key which the user assigns to the lighting unit to operate the lighting unit from then on, such as for turning on or off. Then, the data is communicated to the central master device for general lighting management.

With the prior art method and system the control of lighting units is carried out by forward control only, that is, without any kind of feedback about actual lighting conditions and locations of the lighting units. For example, an object can be illuminated by any number of lighting units directly, but also indirectly as a result of reflections. With the prior art system it is not possible to measure lighting effects caused by different lighting units on an object and to change controlling of the lighting units dependent on the measured lighting effects.

Further, the inventor considered that it could be a great improvement for certain applications if the portable unit could be used by the user like a mouse of a personal computer for tracking and dragging a light effect caused by the lighting units. Such feature is not disclosed by any reference known to applicant.

OBJECT OF THE INVENTION

It is an object of the invention to solve the drawbacks of the prior art and to provide an improvement thereof.

In particular, it is an object of the invention to obtain data about a lighting effect at a specific location caused by the operation of different lighting units and to control said operation dependent on said data and on location data, such that the light effect can be controlled for properties of the light effect dependent on location and the light effect can be dragged while maintaining properties of the light effect.

SUMMARY OF THE INVENTION

The above object of the invention is achieved by a method as described in claim 1. The location data can be obtained in a variety of manners which are well known by a person skilled in this art. Using said location data and some command input from the user of the user control device, the main control device may track the user control device while obtaining data about a light effect it caused at said location. As a result, the main control device is able to learn about light effects it causes at any location covered by the lighting arrangements by any combination of control commands it supplies to the lighting arrangements. Then, the main control device will be able to track a movement of the user control device. In addition, the main control device will then be able to maintain a specific light effect it caused at any location of the user control device, when the user control device is moving or not. This is like dragging a cursor on a computer screen by using a mouse. The main control device may apply any combination of control commands it finds suitable to maintain the lighting effect. The user will not have to worry or even care about it and he may, for example, pay all his attention to create and to achieve a lighting scheme. The above object of the invention is also achieved by a lighting system as described in claim 7.

BRIEF DESCRIPTION OF THE DRAWINGS

The invention will become more gradually apparent from the following exemplary description in connection with the accompanying drawings, in which.

DETAILED DESCRIPTION OF THE INVENTION

Figure 1:
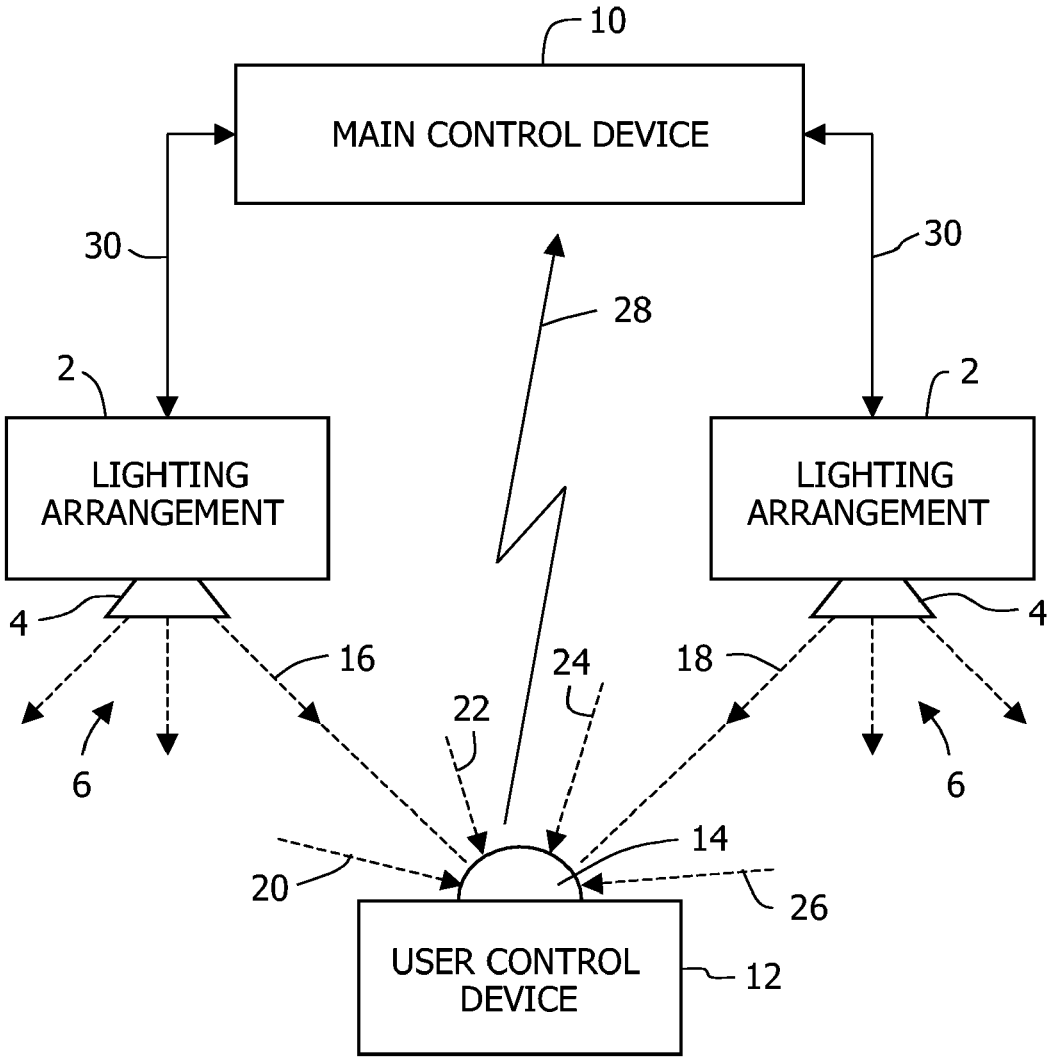
FIG. 1 shows a block diagram of a control system according to the invention in which the method according to the invention is applied.

The system shown in FIG. 1 comprises one or more lighting arrangements 2, which may each comprise one or more lighting units, each lighting unit being schematically indicated by reference numeral 4. Lighting units 4 associated with a lighting arrangement 2 may be arranged at different locations in a room or in some other area to be lighted. Light emitted by a lighting unit 4 is indicated by a group of dashed arrows 6.

A lighting arrangement 2 comprises means, for storing an identification code, which is unique for the lighting arrangement 2, control means for supplying the lighting unit 4, and means for modulating the supply of a lighting unit 4 and therewith modulating the light output of the lighting unit 4, dependent on data, which at least comprises said identification code.

The system shown in FIG. 1 further comprises a main control device 10 and an user control device 12. In particular the user control device 12 is a hand held device, which is portable by a user. The user control device is provided with light sensing means, of which a light entrance dome 14 is shown only, which is suitable to receive light from its environment, that is, from one or more lighting units 4, either directly or indirectly after reflection on objects such as walls. Arrows 16 and 18 indicate light which the user control device 12 receives from different lighting units 4. Arrows 20-26 indicate light which is received by the user control device 12 from other lighting units 4 and/or other sources, possibly by reflection.

The user control device 12 can communicate with the main control device 10 via a wireless connection, which is indicated by reference numeral 28.

Each lighting arrangement 2 is connected to the main control device 10 via a link 30, which can be of any type.

The main control device 10 contains a processor, which runs a control program in concordance with a scheme for lighting locations covered by the lighting units 4 of the lighting arrangements 2, such as for light intensity, light color range and light direction. The program uses data, which is obtained about such locations a priori while using the user control device 12 by a user.

At the time of feeding the main control device 10 with data about lighting conditions at locations covered by the lighting arrangements 2 the user uses the user control device 12 to receive light at each of said locations from any lighting arrangement 2 covering the location, deriving an identification code, of a single lighting arrangement 2 or, in case of receiving composite direct or indirect light from several lighting arrangements 2, several identification codes originating from respective lighting arrangements 2. The user control device measures some property of the received light of interest, apart from representing data, such as average light intensity during some interval. Then, the user control device 12 transmits data, which represents a value of a measured light property together with one or more derived identification codes, to the main control device 10. Then, the program of the main control device 10 can determine the influence or effect a specific control of the main control device 10 has on the lighting at the current location of the user control device 12. Having gained data on several locations, the main control device 10 can control the lighting arrangements 2 in several ways to obtain wanted light effects in some or all of said locations.

It is noted that means for modulating light from a lighting device by data, in particular an identification code, means for receiving such modulated light and deriving the data therefrom is known per se, for example as disclosed by WO 2004/057927 and U.S. Pat. No. 6,333,605. Therefore such means, and other means, which are well known to a skilled person have not been shown and described in detail. In addition, a program and lighting scheme will be dependent on their application, such as for overall lighting exhibition halls, specific lighting objects in exhibition halls and lighting other rooms and areas where specific lighting effects are wanted. Therefore such a program and a lighting scheme have not been discussed in detail.

With the method and system according to the invention means are obtained by which lighting effects, which are a result of controlling lighting arrangements in specific locations, can be determined via an user control device 12 and communicated to the main control device 10 to therewith control the lighting arrangements 2, in any of several possible ways to obtain wanted light effects in said locations.

It is noted that several modifications can be carried out without departing from the scope of the invention as determined by the claims. For example, the data which a lighting arrangement 2 uses to modulate light may comprise data about properties or specifications of the lighting arrangement 2. This additional data can be relayed through the user control device 12 together with the identification code of the lighting arrangement 2 to the main control device 10. Then, the main control device 10 can take said additional data in account when controlling the operation of said lighting arrangement 2 or lighting arrangements 2. Said additional data may refer to capacities about color dependent light intensities, and light directional information.

Thus, with the system as described above it is for instance possible, at any location within a large space illuminated by a plurality of light sources, such as for instance a shop, to locally dim the light intensity, without the user needing to know which of the light sources actually is illuminating that specific location. The user places the user control device 12 at the location of interest (or directs a light receiver of the user control device 12 to the location of interest) and actuates a button corresponding to the command "dim". The user control device 12 receives the light from the corresponding light source or light sources, derives the corresponding identification code(s), and transmits this code(s) to the main control device 10 together with a command signal "dim". The main control device 10 then knows which light sources are to be dimmed. In an alternative example, the user may for instance set a color temperature.

In case the light sources are LEDs, it is relatively easy to implement the modulation of the light output of each light source in order to generate the identification code. LEDs can be switched ON and OFF very quickly, so a LED obeys a controlling modulation signal very well: a modulation at a high modulation frequency and a modulation depth of 100% is easily possible. However, in case the light sources are different types of lamps, such as for instance HID lamps, halogen lamps, etc, modulating the light output with an identification code is more problematic. Such lamps do not switch ON and OFF so fast, so the modulation frequency should be reduced. Further, if such lamps are switched OFF, it may become difficult to re-ignite such lamps reliably and predictably. Further, if modulation is attempted with a frequency high enough to avoid visual flicker effects, it is likely that the light output does not achieve a modulation of 100%, and the light intensity as a function of time is likely to deviate from the modulation signal as a function of time, while the extent of the deviation may vary from lamp to lamp and may even vary from time to time in one and the same lamp. This makes it particularly difficult to establish the extent to which a particular lamp contributes to the lighting intensity at a certain location.

Further, the system as described above relies on the presence of a main control device 10. Adding a light source to the system may be problematic for an average user, because the identification code of the new light source must be communicated to the main control device.

In the following, a further elaboration of the present invention will be described, which provides a solution to these problems.

According to an important aspect of this further elaboration, each light source is provided with a dedicated light sensor, arranged to receive light only, or at least substantially only, from that specific light source. An output signal of this dedicated light sensor thus represents the actual intensity of the light emitted by that specific light source.

According to a further important aspect of this further elaboration, the user control device emits a signal that represents the light as received by the user control device, supplemented by a command signal.

According to a further important aspect of this further elaboration, the system comprises a correlator which receives the signals emitted by the user control device as well as the output signal of the dedicated light sensor of at least one light source. The correlator performs a correlation operation between the received signals, for instance on the basis of Fourier analysis, as is known per se so it is not necessary to explain correlation operations in greater detail here. On the basis of the correlation operation, the correlator determines how much a certain light source contributes to the light as received by the user control device.

According to a further important aspect of this further elaboration, a certain light source responds to the user command only of its contribution to the light as received by the user control device is above a certain threshold.

Figure 2:
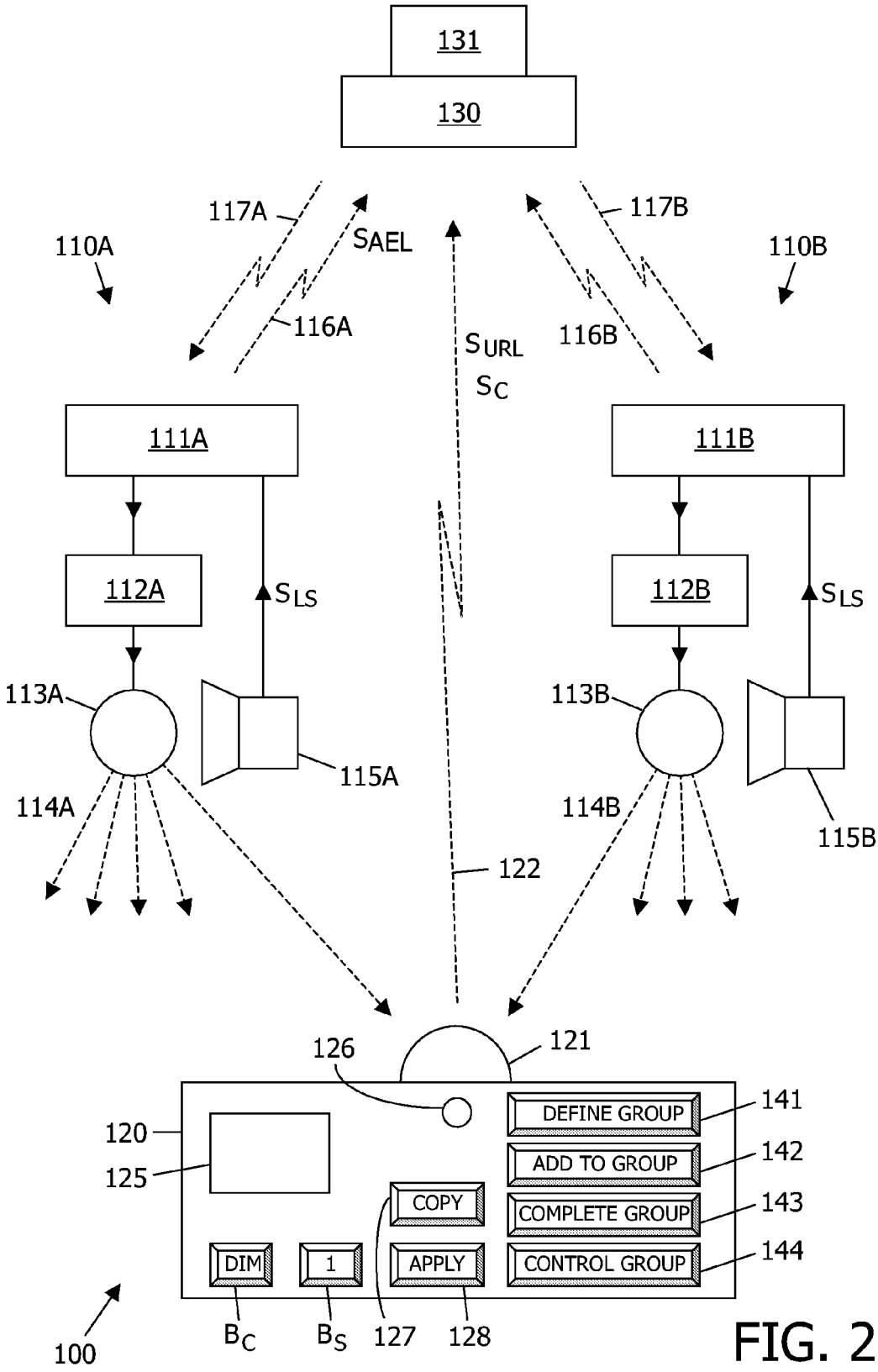
FIG. 2 is a block diagram schematically illustrating a second embodiment of the lighting control system according to the invention.

FIG. 2 schematically shows a lighting system 100, comprising a plurality of lighting assemblies 110, each lighting assembly 110 comprising a controller 111, a ballast 112, and a lamp 113 (for instance a HID lamp) emitting light 114. Individual lighting assemblies and their components are indicated by the same reference numerals yet distinguished by an added character A, B, C, etc. The figure shows two lighting assemblies 110A and 110B, but a practical embodiment may easily comprise more than ten lighting assemblies.

Each lighting assembly 110 further comprises a dedicated light sensor 115, which is arranged in such a way that, for practical purposes, it only receives light from the corresponding lamp 113. In a suitable embodiment, the light sensor 115 may comprise a photo diode or photo transistor. The dedicated light sensor 115 provides its output signal $S_{LS}$ to the controller 111. As illustrated by arrow 116, the controller 111 communicates the received sensor signal to a main control device 130. More particularly, the controller 111 emits a signal representing the light intensity as received by the sensor 115, and thus representing the intensity of the light 114 as emitted by the light source 113, which controller output signal will hereinafter be indicated as assembly-emitted light signal $S_{AEL}$.

The lighting system 100 further comprises a user control device 120, which has a light sensor (schematically represented at 121) receiving light 114 from potentially a plurality of lamps 113, depending on the location and direction of the light sensor 121. The user control device 120 has transmission facilities for communication with the main control device 130, as illustrated by arrow 122. The user control device 120 emits a first signal representing the intensity of the light 114 as received by its light sensor 121, which signal hereinafter will be indicated as user-received light signal $S_{URL}$, and the user control device 120 emits a second signal representing the user command, which signal hereinafter will be indicated as command signal $S_C$.

The light 114 emitted by a light source 113 will exhibit a temporal variation that is unique for that specific light source, and which can be considered as a "fingerprint". The temporal variation may be provided by a deliberate modulation with an identification code, in which case the fact that the modulation depth may be less than 100% is not a problem any more. The temporal variation may also be provided by a deliberate modulation with a regular signal that does not contain an identification code, for instance a brief interruption at a certain frequency.

In the case of a HID lamp, driven by a state of the art electronic ballast, the light output will have frequency components caused by the normal operation of the ballast. Such lamps are typically operated with a commutating direct current: the commutation frequency will leave a characteristic "fingerprint" in the current waveform and hence the emitted light as a function of time: the commutation frequencies of individual free-running commutators will always differ from each other, even if only slightly. Further, each individual lamp will show a characteristic light output behavior on commutation. Further, the lamp current is typically generated by a high-frequency converter, resulting in a characteristic high-frequency ripple on the lamp current and hence a characteristic high-frequency ripple in the output light: the converter frequencies of individual free-running high-frequency converters will always differ from each other, even if only slightly.

In all of the above examples, even if two light assemblies are designed equally, the exact operation frequencies and characteristics will be mutually different, so the characteristics of the temporal variations will be unique "fingerprint" for each lamp. Even if such characteristics change with time, there will always be a one-to-one correspondence between the momentary "fingerprint" of the light emitted by a lamp and the temporal variations of the light received by a sensor, if such sensor receives light from that specific lamp. If a sensor receives light from two or more lamps, the mixed light as received by the sensor can be considered as a summation of several contributions each having individual temporal variations mutually different from each other. The main control device 130 comprises a correlator 131 that is capable of correlating the user-received light signal $S_{URL}$ (representing the mixed light as received by the user control device 120) and the assembly-emitted light signals $S_{AEL}$ (representing the amount of light as emitted by the individual light sources 113 and thus representing the "fingerprint") and, as a result of the correlation operation, to provide correlation coefficients $X_A$, $X_B$, $X_C$, etc, which indicate the quantitative contribution of the respective light sources 113A, 113B, 113C to the mixed light as received by the user control device 120. If expressed as percentage, the summation of all correlation coefficients $X_A$, $X_B$, $X_C$, etc, will ideally be equal to 100%, or less in case daylight or "strange" light sources contribute to the mixed light as received by the user control device 120.

Based on the correlation coefficients $X_A$, $X_B$, $X_C$, etc, provided by the correlator 131, the main control device 130, using pre-programmed decision schemes, determines which lamps 113A, 113B, 113C etc are to respond to the command signal $S_C$. In a possible embodiment, the main control device 130 selects the one lamp corresponding to the largest correlation coefficient. In another possible embodiment, the main control device 130 compares the correlation coefficients $X_A$, $X_B$, $X_C$, etc, with a predetermined threshold $X_{TH}$, for instance 50%, and selects all lamps of which the corresponding correlation coefficient is above said threshold $X_{TH}$. If no correlation coefficients above said threshold $X_{TH}$ are found, the main control device 130 may reduce the threshold $X_{TH}$ in subsequent steps, for instance 40%, 30%, 20%, until one or more correlation coefficients above the reduced threshold are found. After making such selection, the main control device 130 sends the required corresponding command signal to the controllers 111 corresponding to the selected lamps 113 (communication link 117). On receiving a command signal from the main control device 130, an individual controller 111 controls the ballast 212 in a corresponding manner.

In a possible embodiment, the user wishes to dim the light at a certain spot. Thus, the command signal $S_C$ contains the command "reduce illumination level". The main control device 130 determines which lamps are to be controlled because they contribute to the illumination at the specific spot, and sends to these lamps the command "reduce lamp current".

In another possible embodiment, the user wishes to change the color of the light (color temperature) at a certain spot. For instance, the command signal $S_C$ contains the command "more red". The main control device 130 determines which lamps are to be controlled because they contribute to the illumination at the specific spot, and sends to these lamps the command "increase lamp current" or "reduce lamp current", depending on whether such lamp contributes red light or not.

Figure 3:
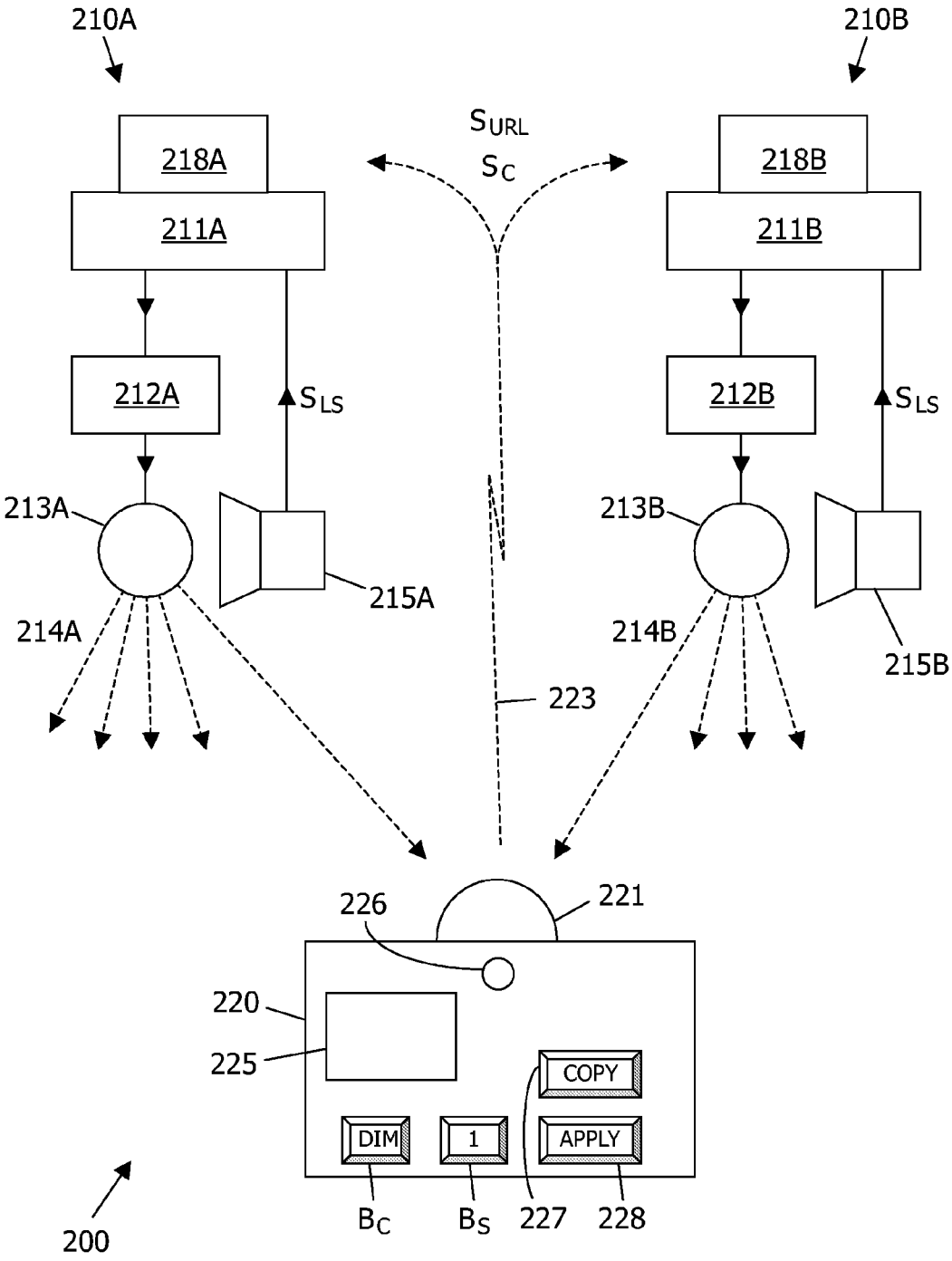
FIG. 3 is a block diagram schematically illustrating a third embodiment of the lighting control system according to the invention.

FIG. 3 schematically shows another embodiment of a lighting system 200 according to the present invention. Components similar to the components of system 100 of FIG. 2 are indicated by the same reference numerals increased by 100. Again, the user control device 220 has transmission facilities for emitting a user-received light signal $S_{URL}$ and a command signal $S_C$, as illustrated by arrow 223. An important feature of this embodiment 200 is that it does not have a central main control device 130. Instead, each individual controller 211 itself receives and processes the signals from the user control device 220, and to that end each individual controller 211 is provided with a correlator 218.

The operation of the correlator 218 is similar as the operation of the correlator 131 described above, and it is not necessary to repeat the explanation of the operation in great detail. The main difference with the embodiment of FIG. 2 is that a correlator 218, apart from the user-received light signal $S_{URL}$ (received from the user control device 220), only receives the sensor output signal $S_{LS}$ from the corresponding sensor 215 of the same assembly 210, which sensor signal $S_{LS}$ represents the amount of light as emitted by the corresponding light source 213 and thus represents the "fingerprint") of the light source 213 of the same assembly 210. The correlator 218 is capable of correlating these two signals and, as a result of the correlation operation, to provide a correlation coefficient X which indicates the quantitative contribution of the corresponding light source 213 to the mixed light as received by the user control device 220. Thus, each individual controller 211 receives information (correlation coefficient X) as to how much its corresponding light source 213 contributes.

Based on this correlation coefficient X provided by the correlator 218, the individual controller 211, using pre-programmed decision schemes, determines whether or not it should respond to the command signal $S_C$. In a possible embodiment, the individual controller 211 compares the correlation coefficient X with a predetermined threshold $X_{TH}$, for instance 50%, and decides to respond to the command signal $S_C$ if the correlation coefficient X is above said threshold $X_{TH}$. After making a positive decision, the individual controller 211 controls the ballast 212 in a manner corresponding to the command signal $S_C$.

In a possible embodiment, the user wishes to dim the light at a certain spot. Thus, the command signal $S_C$ contains the command "reduce illumination level". Each individual controller 211, independently, determines whether it should respond because its corresponding lamp provides a substantial contribution to the illumination at the specific spot, and if yes, it controls the ballast 212 such as to reduce the lamp current.

Thus, the above-described principle of correlation is used in making a decision whether a specific lamp should be selected for following a user command. In an embodiment with a central main controller, the main controller centrally decides which lamps do and which lamps do not respond. In an embodiment with individual controllers, each controller decides whether its lamp should or should not respond.

The user control device 120, 220 may be designed to generate the user command signal $S_C$ as long as the user actuates a corresponding command button $B_C$; in such a case, the user keeps the command button $B_C$ depressed until he is satisfied with the result, then he releases the command button $B_C$ and the user command signal $S_C$ stops. The figures illustrate only one command button $B_C$ for the exemplary command function "dim", but it should be clear that the user control device 120, 220 may have multiple command buttons.

It is also possible that the user control device 120, 220 comprises a memory 125, 225 with one or more predetermined lighting settings, and one or more selection buttons $B_S$ for selecting a specific one of the predetermined lighting settings. The user needs to actuate such selection buttons $B_S$ only once: it is not necessary to keep the button $B_S$ depressed. The user control device 120, 220 generates the appropriate user command signal $S_C$ while monitoring the setting of the mixed light 114 as received by its sensor 121, 221, until it finds that the actual light setting (within a predetermined tolerance limit) corresponds to the selected setting, and then it stops generating the user command signal $S_C$. Conveniently, the user control device 120, 220 is provided with a signaling device 126, 226, for instance a LED, actuated by the user control device 120, 220 when the actual light setting corresponds to the selected setting so that the user knows that he is ready. The figures illustrate only one selection button $B_S$ for selecting the exemplary setting "1", but it should be clear that the user control device 120, 220 may have multiple selection buttons.

In such a way, it is for instance easily possible for a chain of shops to have lighting conditions identical in all shops.

A setting in the memory 125, 225 can be a fixed, predetermined setting. However, it is also possible that the user control device 120, 220 is capable of adding settings to the memory, specifically by "reading" the actual settings. In a further elaboration of the invention, this makes it easily possible to copy the lighting conditions of one location and apply these lighting conditions to a different location. Again, the user control device 120, 220 comprises the memory 125, 225. The user control device 120, 220 further comprises a command button 127, 227 for the function "copy" and a command button 128, 228 for the function "apply". When the user actuates the command button "copy", the user control device 120, 220 stores the actual light settings prevailing at that specific moment and at that specific location into its memory 125, 225. The user may then go to a different location and actuate the command button "apply". In response, the control device 120, 220 generates the appropriate user command signal $S_C$ while monitoring the setting of the mixed light 114 as received by its sensor 121, 221, until it that the actual light setting (within a predetermined tolerance limit) corresponds to the selected setting in its memory, and then it stops generating the user command signal $S_C$. For a user, this is a very easy and intuitive manner of copying lighting settings, comparable to "copy and paste" in computer programs.

In the above, the invention has been described in the context of examples where the decision whether a certain lamp should respond to a user command signal is made (centrally or individually) while that command signal is being sent. Lamps only respond if they substantially contribute to the light received at the location being controlled. Such embodiments are useful in cases where it is desired to control local lighting conditions, for instance the illumination of one object. There are, however, practical situations where it is desirable to control lighting conditions in a larger area, for instance an entire department in a store floor. That area may be one contiguous area or a set of multiple individual areas. As an example, in a clothes shop it may be desirable to control lighting in a ladies' department, men's department, children's department, etc. Further, with time, the extent of these departments may be changed.

The present invention provides an easy way for grouping lamp assemblies together and controlling all assemblies of the same group at the same time.

Reference is made to FIG. 2 again. The user control device 120 comprises a command button 141 for the function "define group", a command button 143 for the function "complete group", and a command button 144 for the function "control group". When the user actuates the "define group" command button 141, the main control device 130 enters a "define group" mode.

The user now takes the user control device 120 to a location within, for instance, the ladies' department, and actuates a button of user control device 120. Such button may be the same "define group" command button, but preferably is a different "add to group" command button 142. As described in the above, the main control device 130 determines which lamps substantially contribute to the illumination at that specific location. However, instead of issuing a command signal for those lamps, the main control device 130 enters those lamps into a group list in its associated memory 125.

The above steps are repeated. The user moves through the ladies' department, and each time when he actuates the "add to group" command button 142, the main control device 130 adds the corresponding lamps to the group list. It should be clear that the number of lamps in the group list depends on circumstances.

It is further noted that this grouping procedure can be performed on the basis of lamp recognition through correlation or on the basis of lamp recognition through receiving lamp identification codes.

When the user is satisfied, he actuates the "complete group" command button 143. When the user actuates the "complete group" command button 143, the main control device 130 exits the "define group" mode and enters the normal control mode described above.

When the user actuates the "control group" command button 144, the main control device 130 enters a "control group" mode, in which the main control device 130 will issue command signals to all lamp members belonging to the same group. The operation is similar as described above: when the user actuates a command button $B_C$, for instance "dim lights", the main control device 130 determines which lamps substantially contribute to the illumination at that specific location, as explained earlier. However, instead of issuing a command signal for those lamps only, the main control device 130 checks its memory to find the group of which those lamps are members. Having found the group, the main control device 130 issues a command signal to all lamps belonging to this group. It should be clear that this includes lamps that are relatively remote from the current location of the user control device 120 so that they do not significantly contribute to the illumination at the current location of the user control device 120. Further, it should be clear that the user can control the entire group from any location where the group members significantly contribute to the illumination.

The user control device 120 may have a signaling device such as a LED for signaling that it is operating in group control mode. The user control device 120 may further have a command button for exiting the group control mode.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. A method for controlling a lighting system, which comprises at least one lighting arrangement, a user control device and a main control device, the method comprising:

providing the lighting arrangement with an identification code;

at the lighting arrangement:

modulating light emitted by the lighting arrangement by lighting arrangement data, which contains the identification code of the lighting arrangement;

at the user controlled device:

receiving light from the lighting arrangement;

deriving received lighting arrangement data from the light received from the lighting arrangement;

generating additional data, which is associated with an identification code contained in the received lighting arrangement data;

transmitting the received lighting arrangement data and the additional data;

at the main control device:

receiving the data from the user controlled device;

controlling the operation of the lighting arrangement dependent on the received data;

wherein, at the user controlled device, the received light is measured to provide a value of at least one property of the light, apart from representing data, to provide at least part of the additional data dependent on which the main control device controls the lighting arrangement.

2. The method according to claim 1, wherein, at the lighting arrangement, lighting arrangement data is comprised with data of at least one property, apart from the identification code, of the lighting arrangement.

3. The method according to claim 1, wherein, at the main control device, the lighting arrangement is controlled in concordance with a control program, a scheme of light effects to be generated by the light arrangement and the data received from the user control device and associated with the lighting arrangement.

4. The method according to claim 3, wherein, at the main control device, the control program and scheme of light effects is applied in concordance with lighting arrangement data from two or more lighting arrangements.

5. A lighting system, comprising:

at least one lighting arrangement, which has a modulator, which modulates the light output of the arrangement by lighting arrangement data, which contains an identification code of the lighting arrangement;

a user controlled device, which has means to receive light from the lighting arrangement to provide received lighting arrangement data contained in the received light, means to generate additional data which is associated with the an identification code contained in the received lighting arrangement data, and means to transmit the received lighting arrangement data and the additional data; and a main control device, which has means to receive data transmitted by the user control device and to control the operation of the lighting arrangement dependent on the data received from the user controlled device, wherein, the user control device measures light received by it to provide a measured value of at least one property, apart from representing data, of the received light, to provide at least part of the additional data dependent on which the main control device controls the lighting arrangement.

6. The lighting system according to claim 5, wherein the lighting arrangement data comprises data of at least one property, apart from the identification code, of the lighting arrangement.

7. The lighting system according to claim 5, wherein the main control device controls the lighting arrangement in concordance with a control program, a scheme of light effects to be generated by the light arrangement and the data received from the user control device and associated with the lighting arrangement.

8. The lighting system according to claim 7, wherein the control program and scheme of light effects is applied in concordance with lighting arrangement data from two or more lighting arrangements.

9. A lighting system, comprising:

a plurality of lighting assemblies, each lighting assembly comprising a light source, a controller for controlling the operation of the light source, and a dedicated light sensor arranged for sensing light generated by the corresponding light source only, wherein the dedicated light sensor provides an output signal to the corresponding controller;

a user control device comprising a light sensor for sensing mixed light generating by one or more of the light sources, at least one user-controllable control button, and transmission facilities for emitting a command signal and a user-received light signal representing the intensity of the light as received by its light sensor;

at least one correlator adapted for calculating a correlation between the user-received light signal and the output signal of at least one dedicated light sensor.

10. The lighting system according to claim 9, wherein each lighting assembly is provided with an associated correlator and with receiver means for receiving the signals emitted by the user control device;

wherein the correlator of a lighting assembly is adapted for calculating a correlation between the user-received light signal and the output signal of the corresponding dedicated light sensor of the same lighting assembly;

and wherein the controller of said lighting assembly is adapted for deciding whether or not to obey the command signal emitted by the user control device on the basis of the result of the correlation operation performed by the correlator.

11. The lighting system according to claim 10, wherein the correlator is adapted to generate a correlation coefficient indicating how much the corresponding light source contributes to the light as received by the user control device;

and wherein the controller is adapted to compare the correlation coefficient provided by the correlator with a predetermined threshold value, and to obey the command signal if the actual correlation coefficient is above said predetermined threshold value otherwise to ignore the command signal.

12. The lighting system according to claim 9, further comprising a main control device equipped with receiver means for receiving the signals emitted by the user control device, wherein the correlator is associated with the main control device; wherein each lighting assembly is capable of communicating to the main control device an assembly-emitted light signal representing the light intensity as received by its corresponding dedicated light sensor;

wherein the correlator of the main control device is adapted for calculating correlations between the user-received light signal and the assembly-emitted light signals of the respective lighting assemblies;

wherein the main control device is adapted for deciding which lighting assemblies should and which lighting assemblies should not respond to the command signal emitted by the user control device on the basis of the result of the correlation operation performed by the correlator;

and wherein the main control device is adapted to send suitable control signals to the controllers of the lighting assemblies which should respond to the command signal.

13. The lighting system according to claim 12, wherein the correlator is adapted to generate correlation coefficients indicating how much the light sources contributes to the light as received by the user control device;

and wherein the main controller is adapted to compare the correlation coefficients with each other and to decide that the one lighting assembly of which the corresponding correlation coefficient has the highest value should respond to the command signal and that all other lighting assemblies should not respond to the command signal.

14. The lighting system according to claim 12, wherein the correlator is adapted to generate correlation coefficients indicating how much the light sources contributes to the light as received by the user control device;

and wherein the main controller is adapted to compare the correlation coefficients with a predetermined threshold value, and to decide that all lighting assemblies of which the corresponding correlation coefficient is above said predetermined threshold value should respond to the command signal and that all other lighting assemblies should not respond to the command signal.

15. The lighting system according to claim 14, wherein, if it appears that no correlation coefficient is above said predetermined threshold value, the main controller is adapted to gradually decrease the threshold value until at least one lighting assembly has a correlation coefficient above the reduced threshold value.

16. The lighting system according to claim 9, wherein the user control device comprises a memory with at least one lighting setting;

wherein the user control device comprises at least one user-operable selection button for selecting a certain setting from the memory;

and wherein the user control device, in response to actuation of its selection button, is adapted to generate an appropriate user command signal while monitoring the setting of the mixed light as received by its sensor, until it finds that the actual light setting corresponds to the selected setting.

17. The lighting system according to claim 16, wherein the user control device comprises a signaling device, for instance a LED, actuated by the user control device when the actual light setting corresponds to the selected setting.

18. The lighting system according to claim 16, wherein said lighting setting is a predetermined setting.

19. The lighting system according to claim 16, wherein said lighting setting is user-amendable setting.

20. The lighting system according to claim 19, wherein the user control device comprises a user-operable copy button, and wherein the user control device, in response to actuation of its copy button, is adapted to store the actual light settings prevailing at that specific moment and at that specific location into its memory.

21. The lighting system according to claim 12, wherein the main control device is capable of operating in a group definition mode in which the main control device, in stead of sending suitable control signals to the controllers of the lighting assemblies which on the basis of the current correlation should respond to the command signal, is adapted to add those lighting assemblies into a group list in its memory;

and wherein the main control device is capable of operating in a group controlling mode in which the main control device, if the correlation operation has the result that at least one lighting assembly belonging to a group list in its memory should respond to the command signal, is adapted to send suitable control signals to the controllers of all lighting assemblies belonging to that group.

22. A lighting system, comprising:

a plurality of lighting assemblies, each lighting assembly comprising a light source, and a controller for controlling the operation of the light source, each light source adapted to incorporate an identification code in its output light;

a user control device comprising a light sensor for sensing mixed light generating by one or more of the light sources, at least one user-controllable control button, and transmission facilities for emitting a command signal and a user-received light signal representing the identification codes of the light as received by its light sensor;

a main control device equipped with receiver means for receiving the signals emitted by the user control device; wherein each lighting assembly is capable of communicating to the main control device an assembly-emitted light signal representing the identification code as transmitted by its corresponding light source;

wherein the main control device is adapted for determining a correspondence between one or more identification codes in the user-received light signal and one or more identification codes in the assembly-emitted light signals of the respective lighting assemblies;

wherein the main control device is adapted for deciding which lighting assemblies should and which lighting assemblies should not respond to the command signal emitted by the user control device on the basis of the result of the correspondence determined by the main control device;

and wherein the main control device is adapted to send suitable control signals to the controllers of the lighting assemblies which should respond to the command signal;

wherein the main control device is capable of operating in a group definition mode in which the main control device, instead of sending suitable control signals to the controllers of the lighting assemblies which on the basis of the current correspondence should respond to the command signal, is adapted to add those lighting assemblies into a group list in its memory;

and wherein the main control device is capable of operating in a group controlling mode in which the main control device, if the correspondence shows that at least one lighting assembly belonging to a group list in its memory should respond to the command signal, is adapted to send suitable control signals to the controllers of all lighting assemblies belonging to that group.

* * * * *